United States Patent [19]

Toso et al.

[11] Patent Number: 4,773,106

[45] Date of Patent: Sep. 27, 1988

[54] BACK SUPPORT

[76] Inventors: Victor Toso, 842 - 22nd Ave., SE., Minneapolis, Minn. 55414; Stuart H. Spector, 7345 SW. 107th Ter., Miami, Fla. 33156

[21] Appl. No.: 917,497

[22] Filed: Oct. 10, 1986

[51] Int. Cl.[4] ..... A47C 20/00

[52] U.S. Cl. ..... 5/432; 5/443; 128/78; 297/464

[58] Field of Search ..... 5/432, 443, 431, 434, 5/436, 444, 445; 128/78, 60; 272/126, 135, 137; 297/464, 465

[56] References Cited

U.S. PATENT DOCUMENTS

| | | | |
|---|---|---|---|
| 324,498 | 8/1885 | Surbaugh | 272/126 X |
| 879,534 | 2/1908 | Fraser | 5/443 X |
| 1,266,374 | 5/1918 | Ziegler | 5/432 |
| 2,056,767 | 10/1936 | Blath | 5/432 X |
| 2,250,267 | 7/1941 | Lins | 5/431 X |
| 2,280,274 | 4/1942 | Wildermuth | 128/60 |
| 4,223,670 | 9/1980 | Cramer | 128/134 |
| 4,324,012 | 4/1982 | Cannaday | 5/432 |
| 4,471,993 | 9/1984 | Watson | 5/432 X |
| 4,475,543 | 10/1984 | Brooks et al. | 128/78 |
| 4,627,109 | 12/1986 | Carabelli et al. | 128/78 X |

FOREIGN PATENT DOCUMENTS

| | | | |
|---|---|---|---|
| 960101 | 4/1950 | France | 5/432 |
| 5919 | of 1915 | United Kingdom | 5/432 |
| 188750 | 11/1922 | United Kingdom | 5/432 |

*Primary Examiner*—Alexander Grosz
*Attorney, Agent, or Firm*—N. J. Aquilino

[57] ABSTRACT

A back supporting device which permits a wearer to sit in an upright position for extended periods of time without discomfort including a flexible padded back support dimensioned to engage and support the lower back of the wearer and straps attached to the end of the pad which are adapted to loop around the knees of the wearer when in a sitting position in order to tension the support against the wearer's back.

6 Claims, 2 Drawing Sheets

BACK SUPPORT

BACKROUND OF THE INVENTION

This application is related to applications Ser. Nos. 798,008 filed 11/14/85, and 578,822, filed 2/10/84, both abandoned.

The present invention relates to back support devices, and in particular to a device for supporting a lower back region of a person in a seated position.

When an individual is seated upright on a flat surface without a rigid back support, such as on the ground or a floor, or in a backless chair, such positions become uncomfortable. This discomfort is contributed to by the lack of support at the lumbar region and such discomfort will occur after a relatively short period of time for people with poor posture and/or a weak back structure.

Long periods of sitting in an upright position are encountered by individuals who practice meditation, such as yoga and other similar disciplines. Various sporting activities including, canoeing and hunting in a stationary blind, also require prolonged periods of sitting where the aforementioned discomfort problems can occur. These practices and others which require sitting in an upright position have created a need for a simple, inexpensive device which will give the needed back support to make such activities comfortable.

Back rests and similar supports are shown in the U.S. Pat. No. to Ziegler 1,266,374, Swiss Pat. No. to Wehinger 259,006, British Pat. No. to McConnell 188,750, and Australian Pat. No. to Rose 28,347.

THE INVENTION

The present invention includes a generally rectangular padded back support which is dimensioned and adapted to support the lumbar region of a user. The back support includes a pair of inelastic straps extending longitudinally from the ends of the support, terminating in loops which are dimensioned to engage the knees of the user in one of the aforementioned seating positions. The straps further include knee pads which are adjustably positioned on the straps to cover the knees of the user with the support in place. Each strap includes a suitable buckle which is adjustable so that the length of the straps may be fitted to various sized individuals.

The general object of the invention to provide a back supporting device which enables one to sit upright comfortably for prolonged periods of time without a rigid back support.

It is a particular object of the invention to provide a lower back support device adapted to be worn by an individual sitting on a ground surface with the legs criss-crossed, on a ground surface in a position with the legs uncrossed and knees up, and on a backless chair or a bench.

It is still another object to provide a flexible back support which is adjustable to fit various sized individuals and which is adjustable for a variety of sitting positions.

DESCRIPTION OF THE PREFERRED EMBODIMENTS

Figure 1:
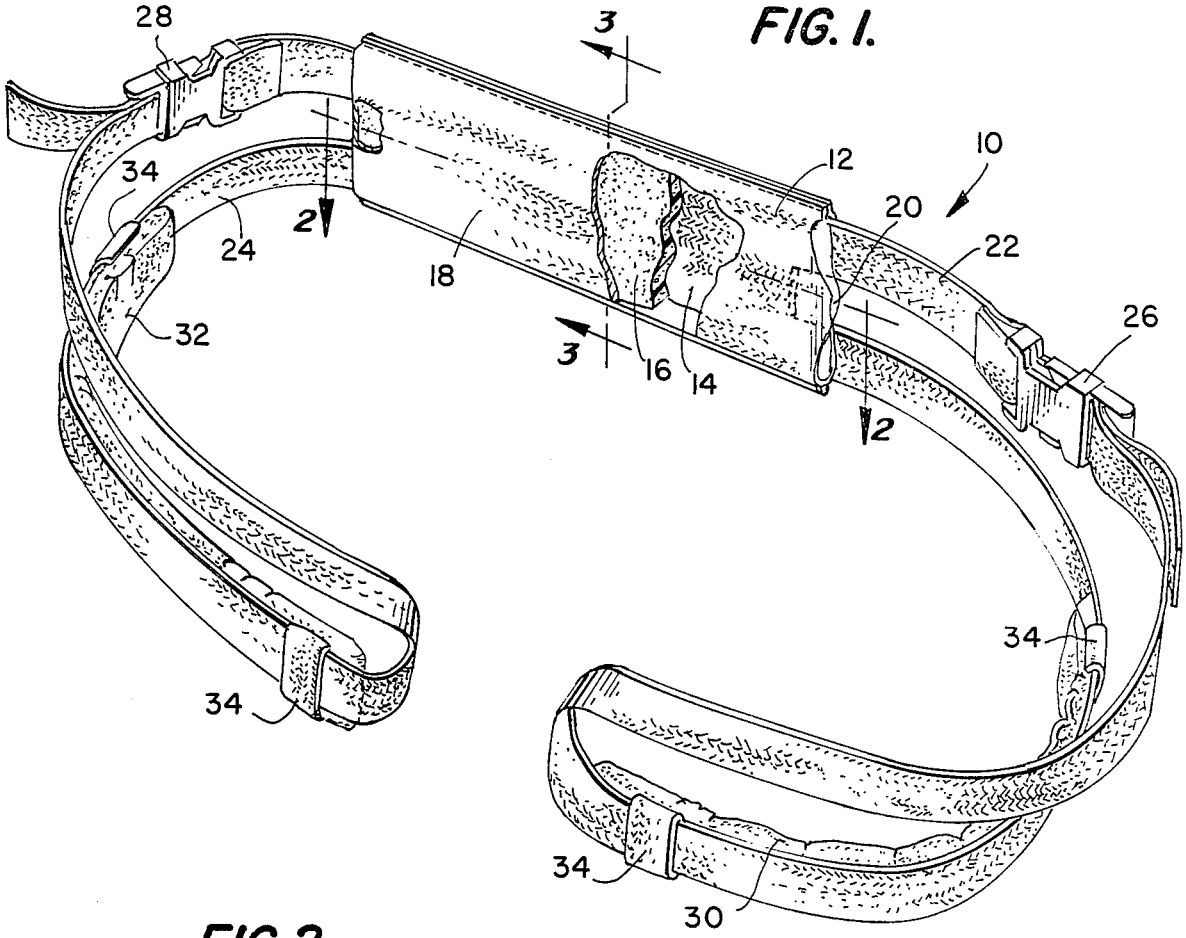
FIG. 1 is a perspective view of the back support in accordance with the present invention.
Figure 2:
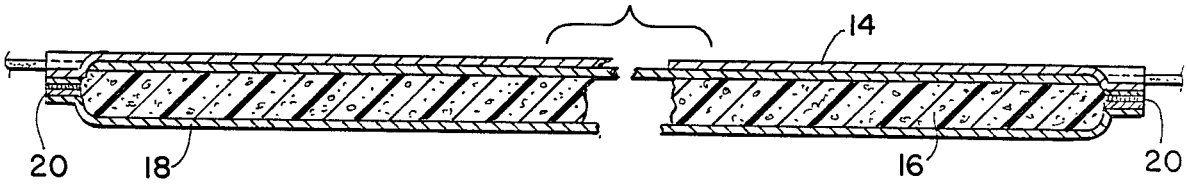
FIG. 2 is a sectional view taken along the lines 2—2 of FIG. 1.
Figure 3:
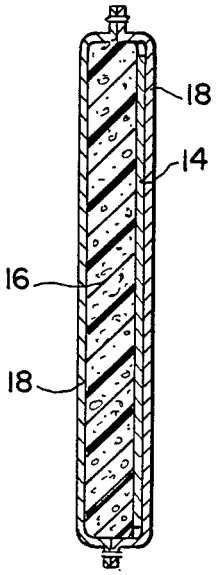
FIG. 3 is sectional view taken along the lines of 3—3 of FIG. 1.
Figure 4:
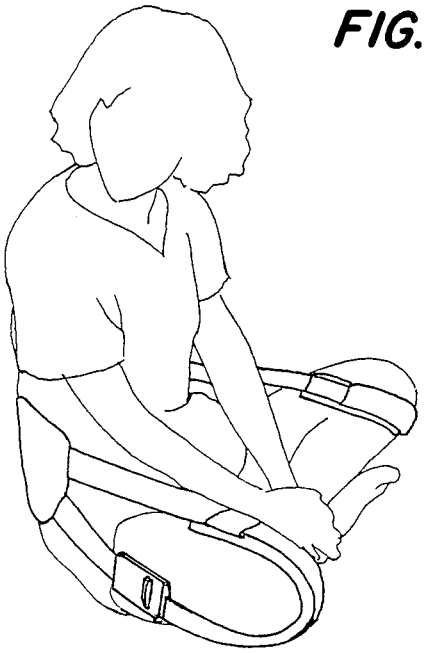
FIG. 4 is a frontal perspective view of an individual seated in a lotus posture position wearing the back support of the present invention.
Figure 5:
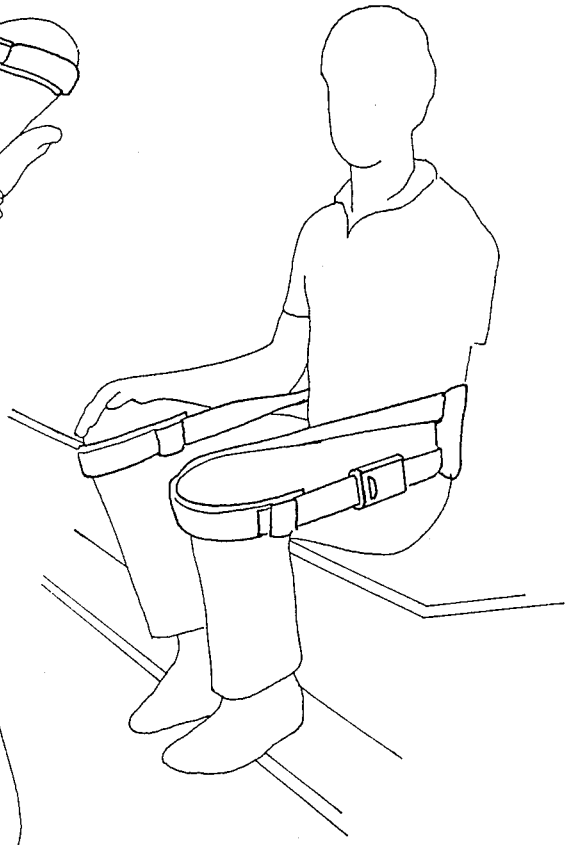
FIG. 5 is a frontal perspective view of a individual seated on a backless bench wearing the back support of the present invention.
Figure 6:
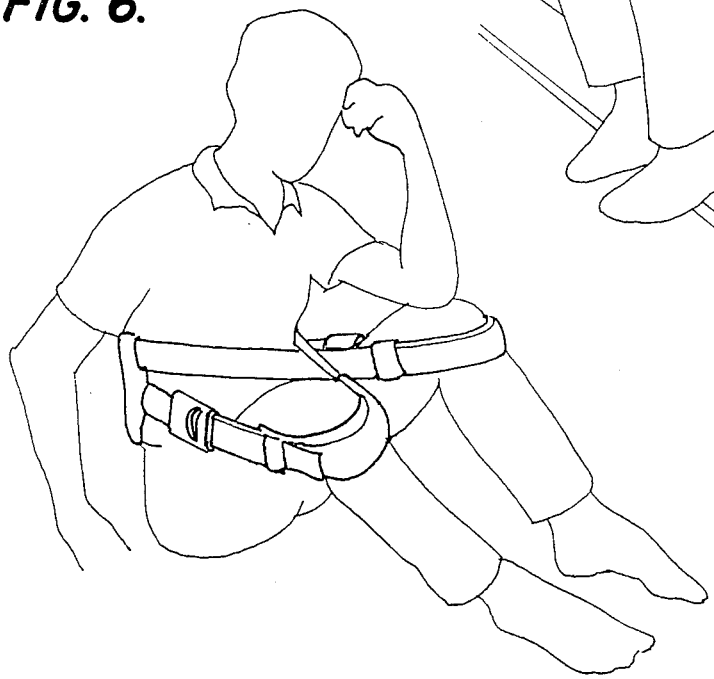
FIG. 6 is a frontal perspective view of an individual seated on a ground surface with legs uncrossed and knees up and wearing the back support of the present invention.

FIGS. 1, 2 and 3 illustrate a padded back support 10 of the present invention. The back support 10 is shaped to wrap around the lower back portion of the wearer and support the lumbar region of the back of the wearer as shown in FIGS. 4, 5 and 6. In this embodiment, the back support 10 is formed of a unitary, double-ended, flexible, rectangular member 14 which preferably is made of a strong fabric material such as canvas or belting material. The member 14 is dimensioned to have a length which extends around the lower back of the user and a width which extends the height of the lumbar region. The back support 10 includes a foam cushion 16 approximately the same size as the member 14. The cushion 16 is held in place by an outer sleeve 18 of flexible fabric material, which fits over the cushion 16 and the member 14. The sleeve 18 is provided with hook and loop type separable fasteners 20 which secure the ends of the sleeve 18 in order to maintain the cushion 16 within the sleeve 18 and relative to the flexible member 14.

A pair of elongated straps 22 and 24, which terminate in loops, are attached to the ends of the member 14 by suitable conventional means such as by sewing or the like. Alternately, the straps 22 and 24 may be integral extensions of the member 14. Each of the straps 22 and 24 include adjustable buckles 26 and 728, respectively. The buckles are shown as "snap-in" types, but it will be appreciated that any type of buckle fastener would be equally applicable to the present structure, including a hook and loop separable fastener closure assembly. The straps 22 and 24 include elongated knee pads 30 and 32 which are adjustably positioned on the straps 23 and 24 using support loops 34. This enables the knee pads 30 and 32 to be slideably moved along the length of the straps 22 and 24. The knee pads cover the knees of the user and a portion of the legs when in use. The straps 22 and 24 are made of flexible, inelastic material of sufficient strength to withstand the body forces when used.

Again referring to FIGS. 4, 5 and 6, when the user is in one of the various seated positions, the back support 10 is placed against the lumbar portion of the back. The elongated straps 22 and 24 are looped around the knees. The pads 30 and 32 are slideably positioned on the straps 22 and 24 in order to engage the knees as shown. If necessary, the length of the loops may be adjusted with the buckle fasteners in order to provide a proper fit.

Figure 7:
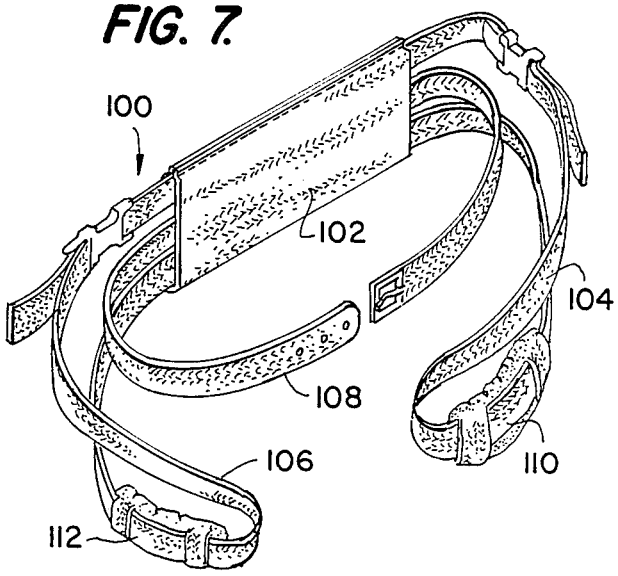
FIG. 7 is a perspective view of another embodiment of the back support of the present invention.

FIG. 7 illustrates another embodiment of the back support 100 of the present invention. In this embodiment, the support is similar to that described with respect to the embodiment of FIGS. 1 to 3 and includes a flexible rectangular member 102 and elongated straps 104 and 106 of the same type described with respect to the earlier embodiment. The back support 100 further includes a retainer strap 108 which is adapted to encircle the torso of a user and be secured in place so that the support 100 may be worn on the back without the necessity of having the elongated straps looped over the knees to maintain the support in place. Of course, this does not provide any supporting function, but does eliminate the need for repositioning the support 100 each time it is to be used, and also facilitates engaging the elongated straps 104 and 106 over the knees of the user without having to be concerned with positioning the support 100 in the proper place during the engagement procedure. It also facilitates carrying the back support 100 without the need of a separate carrying case or without continuously holding the item. In situations where the user may be engaged in a sporting activity such as rowing, canoeing, motorcycling, or hunting, the straps 104 and 106 may be disengaged from the knees and other activities engaged in without the requirement of having to be concerned with the back support 100.

In this embodiment, the back support 100 also includes knee pads 110 and 112 which are slideably mounted on the elongated straps 104 and 106. The knee pads 110 and 112 are sized so as to fit directly over the knees of the user without having to be extended along the length of the elongated straps.

Other modifications and alterations to the above-described structure may be made. For example, the back support may be made as a completely unitary structure having the straps integrally attached thereto. The back support may be also made of rigid or semi-rigid sections and specific individuals could be fitted with supports that are molded specifically to their body contours. The back support may also be made of a plurality of strap sections without departing from the scope of the present invention as defined in the following claims.

We claim:

1. A support device for supporting the lower back region of a user in a seated position comprising:

a double-ended, flexible, rectangular, back supporting member having a length substantially spanning the width of the lower back of said user and a width substantially spanning the height of the lumbar portion of said user;

a pair of elongated straps attached to and extending from the ends of said double-ended, back-supporting member; said straps forming loops and being of such a length to engage the knees of said user when said user is in a seated position;

and a pair of knee pads slideably positioned on said straps; said knee pads being sized to cover the knees of said user;

whereby the force of said user's knees on said straps pulls said back supporting member against the lower back of said user enabling said user to sit upright comfortably for extended periods of time.

2. The support device of claim 1 wherein said back supporting member further includes a cushion.

3. The support device of claim 2 wherein said back supporting member further includes a double-ended open flexible sleeve covering said cushion and said back supporting member for maintaining said cushion and said back supporting member together.

4. The support device of claim 3 further including separable fastener means at each of the ends of said double-ended open sleeve to permit closure thereof.

5. The support device of claim 1 further including a retainer strap attached to said double-ended rectangular back supporting member; said retainer strap being adapted to encircle the torso of a user and in use maintaining said back supporting member in place on the lower back of said user without the necessity of said elongated straps being engaged on the knees of said user.

6. A method of supporting the lumbar region of a user in a seated position comprising the steps of:

locating a padded support member on said lumbar region; securing padded straps to said support member and forming a loop with said padded straps and looping the same. around the knees of said user; and exerting an outward force with the knees against the straps thereby pulling said support member against said lumbar region and supporting the same.

* * * * *

Disclaimer 4,773,106.—*Victor Toso*, Minneapolis, Minn.; *Stuart H. Spector*, Miami, Fla. BACK SUPPORT. Patent dated Sept. 27, 1988. Disclaimer filed Aug. 1, 1989, by the inventors.

Hereby enters this disclaimer to claims 1, 2, 3, 4, and 6 of said patent.

[ *Official Gazette January 30, 1990* ]